US012195237B2

(12) United States Patent
Unterlechner

(10) Patent No.: US 12,195,237 B2
(45) Date of Patent: Jan. 14, 2025

(54) EXTRUSION BLOW MOLDED CONTAINER

(71) Applicant: ALPLA WERKE ALWIN LEHNER GMBH & CO. KG, Hard (AT)

(72) Inventor: Oliver Unterlechner, Bregenz (AT)

(73) Assignee: ALPLA WERKE ALWIN LEHNER GMBH & CO. KG (AT)

( * ) Notice: Subject to any disclaimer, the term of this patent is extended or adjusted under 35 U.S.C. 154(b) by 38 days.

(21) Appl. No.: 17/773,837

(22) PCT Filed: Oct. 29, 2020

(86) PCT No.: PCT/EP2020/080445
§ 371 (c)(1),
(2) Date: May 2, 2022

(87) PCT Pub. No.: WO2021/084029
PCT Pub. Date: May 6, 2021

(65) Prior Publication Data

US 2022/0380091 A1 Dec. 1, 2022

(30) Foreign Application Priority Data

Oct. 31, 2019 (CH) ..... 01377/19

(51) Int. Cl.
*B65D 1/02* (2006.01)
*B65D 25/42* (2006.01)
(Continued)

(52) U.S. Cl.
CPC ..... *B65D 25/42* (2013.01); *B65D 1/0223* (2013.01); *B65D 1/0238* (2013.01); *B65D 47/122* (2013.01); *B65D 75/5822* (2013.01)

(58) Field of Classification Search
CPC .... B65D 25/42; B65D 1/0238; B65D 47/122; B65D 75/5822; B65D 1/0223
See application file for complete search history.

(56) References Cited

U.S. PATENT DOCUMENTS 970,384 A * 9/1910 McGrane ..... B65D 1/0238 215/901
3,156,383 A 11/1964 Gino
(Continued)

FOREIGN PATENT DOCUMENTS

EP 3431409 A1 1/2019
FR 1204664 A 1/1960
(Continued)

OTHER PUBLICATIONS

Written Opinion of the International Searching Authority, International Application No. PCT/EP2020/080445; mailed Feb. 18, 2021; 3 pages.
(Continued)

*Primary Examiner* — Frederick C Nicolas
(74) *Attorney, Agent, or Firm* — MORRISS O'BRYANT COMPAGNI CANNON, PLLC

(57) ABSTRACT

The invention relates to a container produced from a plastic material in extrusion blow molds with a container body, having a first end, and a second end substantially opposite the first end, a first and second sealing surface formed on the inner wall of the first end, wherein the first and second sealing surfaces surround a filling opening and can be connected to one another in a fluid-tight manner, and a container base having a standing surface formed at the second end. A pouring element is formed on the container at the first end below the first and second sealing surfaces.

27 Claims, 7 Drawing Sheets

(51) Int. Cl.
*B65D 47/12* (2006.01)
*B65D 75/58* (2006.01)

(56) References Cited

U.S. PATENT DOCUMENTS

| | | | | | |
|---|---|---|---|---|---|
| 3,182,861 | A | | 5/1965 | Paul | |
| 5,358,148 | A | * | 10/1994 | Hanifl | B65D 47/141 220/666 |
| 5,667,101 | A | * | 9/1997 | Barrash | B65D 25/465 222/481.5 |
| 2005/0205618 | A1 | * | 9/2005 | Mabee | B65D 47/0814 222/541.9 |
| 2008/0123466 | A1 | * | 5/2008 | Thompson | B29B 7/36 222/145.6 |
| 2012/0261421 | A1 | * | 10/2012 | Yourist | B65D 55/16 264/531 |
| 2015/0183563 | A1 | * | 7/2015 | Luizzi | B65D 77/065 53/449 |
| 2017/0088344 | A1 | * | 3/2017 | Herrick | B65D 75/563 |

FOREIGN PATENT DOCUMENTS

| | | | |
|---|---|---|---|
| FR | 1573161 | A | 7/1969 |
| GB | 1047236 | A | 11/1966 |
| WO | 2017072185 | A1 | 5/2017 |

OTHER PUBLICATIONS

International Search Report, International Application No. PCT/EP2020/080445; mailed Feb. 18, 2021; 2 pages.

* cited by examiner

EXTRUSION BLOW MOLDED CONTAINER

CROSS-REFERENCE TO RELATED APPLICATIONS

This application is a national phase entry under 37 U.S.C § 371 of PCT/EP2020/080445 filed Oct. 29, 2020, which claims priority to Swiss Patent Application No. 01377/19 filed Oct. 31, 2019, the entirety of each of which is incorporated by this reference.

FIELD OF THE INVENTION

The invention relates to a container produced from a plastic material in extrusion blow molds.

PRIOR ART

The production of plastic containers, especially plastic bottles, for example made of polyethylene or polypropylene, takes place in extrusion blow molds. In this case, plastic suitable for blow molding is plasticized and introduced into a tube head by means of an extruder. In the tube head, the plastic is formed into a tube, which is introduced into a blow molding tool. The hose is introduced into the blow molding tool, inflated by overpressure of a gas when the tool is closed so that the hose expands and is pressed against an inner wall of a cavity of the blow molding tool, and assumes the shape of the inner wall, which has a shape that is the negative of a container. The container blown out of the hose is cooled by means of the inner wall until the plastic is hardened. Subsequently, the container is removed from the opened blow molding tool. In a separate step, the so-called slugs, which are formed by the protrusion of the tube during the closing of the blow mold and are generally connected to the removed container, are cut off and can be directed to recycling. The hose can be single-layer or multi-layered.

As a rule, the outlet openings are formed at one end of the container during the blow molding process. Accordingly, during the filling process, the containers are filled via the outlet opening. Thus, the filling speed at the filling line is dependent on the cross section of the outlet opening and the consistency of the product to with which a container is to be filled.

In order to enable an increased filling rate, WO 2017/072185 A1 discloses an extrusion blow molded container that has a first open end and a second end. The first end has a first and a second sealing surface. The sealing surfaces surround a filling opening and can be connected in a fluid-tight manner after filling. The second end is formed as a container base with a standing surface. The fact that the filling opening can extend at most over the entire cross section of the container makes the rapid filling of the container possible.

For pouring the filling material, the container must be cut open or a closure element must be laminated in between the sealing surfaces with a pour opening. If the container is cut open, a pour opening is produced, which pour opening is less user-friendly, because filling material can easily be spilled during the pouring. If a closure element is present, the closure element must be inserted between the sealing surfaces before it can be welded thereto. In addition, the closure element can be produced from a plastic different than that of the container, as a result of which single-type disposal of the container is not possible.

ADVANTAGES OF THE INVENTION

From the disadvantages of the prior art described, the claimed invention creates an extrusion blow molded container that enables the rapid filling and user-friendly opening and pouring of the container, wherein the container is to be able to be produced easily and quickly at the same time.

SUMMARY OF THE INVENTION

The advantages are achieved with a container produced from a plastic material, especially in extrusion blow molds, by the claimed invention. The dependent claims set out developments and/or advantageous alternative embodiments.

The invention comprises a pouring element being formed on the container at the first end below the first and second sealing surfaces. The pouring element is therefore an integral component of the container and does not have to be subsequently connected thereto after its manufacture. The container can be easily emptied via the pouring element and the pouring element is not in the way when the filling opening is closed.

In a particular embodiment of the invention, the pouring element is blow molded together with the container. The provision of the pouring element therefore does not require an additional production step, but is blown in the identical mold and at the same time as the container. The production of the container therefore takes place quickly and with no additional production effort. No leaking locations can occur between the pouring element and the container body, because both are blown out from the identical extruded plastic hose. Clearly visible are extrusion blow molded containers on a seam on the underside of the base that arise when the mold is moved together due to the free end of the plastic hose being pressed together. It proves to be particularly advantageous if the first and second sealing surfaces form a seam with a long side and a first and second seam end when the sealing surfaces are connected in a fluid-tight manner and a first and a second shoulder are formed on the container adjacent to the long side of the seam. After the rapid filling of the container, the container can be reliably closed by a correspondingly dimensioned filling opening.

The position of the pouring element relative to the seam is to be selected such that the following production parameters are fulfilled, because otherwise the container cannot be produced or has an unsatisfactory quality. At the location at which the pouring element is formed, sufficient plastic material of the extruded tube must be present. The pouring element is to be positioned relative to the filling opening such that the pouring element is not deformed or distorted when the filling opening is closed. The container seam that is produced during the blowing operation in a two-part mold should coincide with the seam of the sealing surfaces. The following 10 embodiments meet these production parameters, wherein not all production parameters can be met equally well.

It has proven expedient if the pouring element is formed below the long side of the seam.

It has proven expedient if the pouring element is formed below the first or second seam end.

Advantageously, the base has the shape of an ellipse with a main axis and a secondary axis, whereby the container has two opposite long sides and two opposite short sides. A container with such a base shape can be produced in a relatively simple blow mold.

It has proven expedient if the seam is oriented parallel to the main axis.

It has proven expedient if the seam is oriented parallel to the secondary axis.

It has proven expedient if the pouring element is formed on one of the short sides.

It has proven expedient if the pouring element is formed on one of the long sides.

It has proven expedient if the first shoulder is longer than the second shoulder and the pouring element is formed on the first shoulder.

It has proven expedient if the pouring element is teardrop-shaped in cross section.

It has proven expedient if a teardrop-shaped base is formed at the transition from the pouring element to the container body.

The pouring element expediently has a height so that it lies within the contours of the container base in a top view of the container. As a result, the requirements for the blow mold are simplified and the pouring element can be shaped in a dimensionally accurate manner. In addition, this enables simplified palletizing, because the pouring element does not protrude. This is also advantageous if the container is to be decorated in a decorated manner or wrapped with a shrink film. In a further embodiment of the invention, the pouring element has a neck, a cap and a pour opening, wherein the cap closes off the pour opening. The pour opening therefore does not have to be closed afterward and the cap can be cut off from the pouring element.

A cutting line is advantageously formed on the neck. For opening the container, therefore, only the cap is cut off along the cutting line. The cutting line represents a depression in the neck of the pouring element.

In a further embodiment of the invention, the cap is connected to the container body by a holding strip. As a result, the cap is captively held on the container body, and it is ensured that the cap is disposed of together with the rest of the container.

Due to the fact that the pouring element is advantageously olive-shaped in cross section, a pair of shears only needs to be opened slightly for cutting off the cap and be placed on the narrow side of the neck.

In a further embodiment of the invention, the pouring element has the shape of a pyramid, wherein one side of the pyramid is the cut-off cap. It may be a three-sided pyramid, wherein other pyramid shapes are also conceivable. Such a pouring element may have a low height. The cap can be oriented downward, whereby the container does not have to be inclined as much during pouring. The cap can also be oriented upward. The pouring element is then designed in the manner of a spout of a teapot, which makes for user-friendly pouring without spillage, also because the container is still completely filled.

The cap expediently has the shape of a truncated cone. After the cap has been cut off, the cap can be inserted inversely into the pour opening and is held in the pour opening in a force-locking manner. As a result, the pouring element can be closed again.

In a further embodiment of the invention, the pouring element adjoins the long side of the seam or projects into the seam. As a result, a dead space between the seam and the pouring element is avoided and the container can be completely emptied. If the pouring element protrudes into the seam or the seam region, it can be cut open by cutting off part of the seam.

It proves advantageous if the pouring element is a lens-shaped projection. This can be arranged particularly close to the seam, because it does not impede the sealing jaws during welding of the filling opening. With specially formed welding jaws, it is possible for the lens-shaped projection to protrude into the weld seam or into the weld seam region. For example, it is conceivable that two coincident weld seams are provided and the lower one is discontinuous in the region of the lens-shaped projection. It is also conceivable that the weld seam partially surrounds or frames the projection.

In an advantageous manner, a lens-shaped projection is formed on each of the first and the second shoulders, which projections lie opposite the shoulders. As a result, the opposite pouring elements can be cut off together with a part of the seam and form a common pour opening.

A ventilation opening is expediently provided on the container. This is expediently arranged opposite the pouring element and can be a cut-off nipple. As a result, the filling material can flow homogeneously and uniformly out of the container.

It proves advantageous if the pouring element has fastening means that can be brought into engagement with corresponding fastening means of a closure cap in such a way that the outlet opening can be closed in a fluid-tight manner. The fastening means may be an external thread on the neck of the pouring element, which interacts with an internal thread of the closure cap.

The cutting line is advantageously interrupted and the interrupted region acts as a hinge for the cap. The cap can be folded away during pouring and is held against the container after the container is first opened.

It proves to be particularly advantageous if the container is integrally formed. As a result, not only are further production steps obsolete, but rather single-type disposal of the container together with the pouring element is possible.

With regard to the plastics material according to the invention, it should especially be observed that this should be weldable or adhesive at least in the region to be sealed. In this context, reference is made to the disclosure of WO 2017/072185 A1.

BRIEF DESCRIPTION OF THE DRAWINGS

Further advantages and features become apparent from the following description of a plurality of exemplary embodiments of the invention with reference to the schematic representations. Shown, in a representation not true to scale, are.

DETAILED DESCRIPTION OF THE ILLUSTRATED EMBODIMENTS

Figure 1:
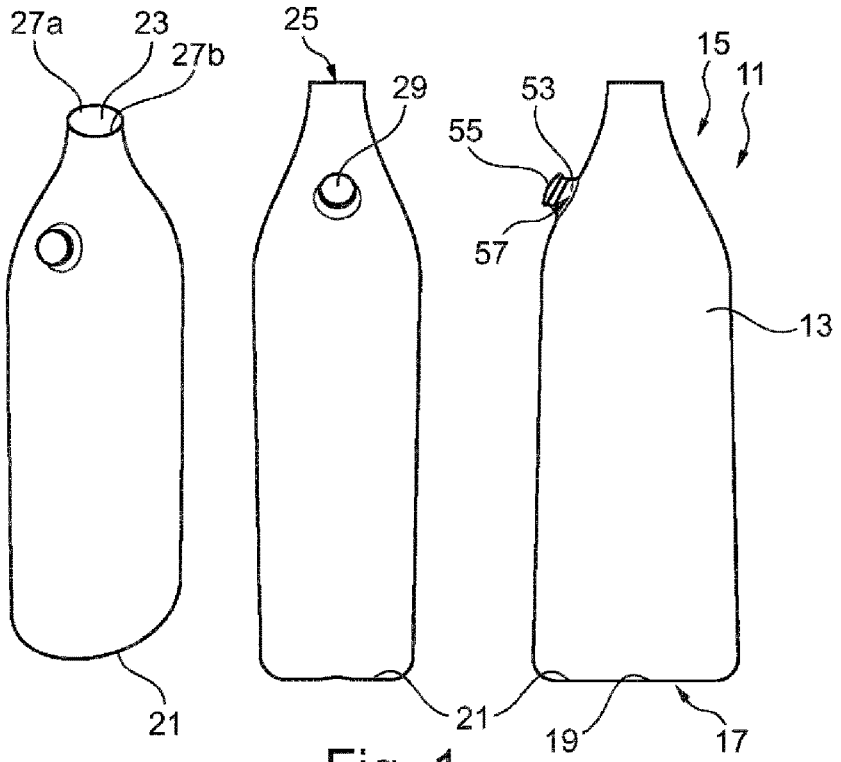
FIG. 1: a 1st embodiment of an extrusion blow molded container in 3 views.

FIGS. 1 to 10 and 21 and 22 show possible embodiments of a container that is produced from a plastic material in extrusion blow molds and is designated overall by the reference sign 11. FIGS. 1 to 10 each show a front view, a side view and a perspective view of the respective embodiment of the container 11.

The container 11 has a container body 13 that has a first end 15 and a second end 17 that is substantially opposite the first end 15. The second end 17 is closed in a fluid-tight manner and is designed as a container base 19 on which a standing surface 21 is formed. The extrusion blow molded container 11 has an inner wall 23. The inner wall 23 delimits at the first end 15 a filling opening 25 through which a filling material is added into the extrusion blow molded container 11. The first end 15 has on its inner wall 23 a first sealing surface 27*a* and a second sealing surface 27*b* opposite the first sealing surface 27*a*, which can be connected to one another in a fluid-tight manner and are connected to one another in a fluid-tight manner after the filling material has been added. For this purpose, the sealing surfaces 27*a*, 27*b* can be welded. The container 11 may be produced from a weldable plastic. Alternatively, the sealing surfaces 27*a*, 27*b* can be coated with a hot-melt adhesive or an adhesion promoter, which can also be textured. The filling opening 25 has a such a width that the container can be filled quickly with filling material and without overflow into the container 11.

A pouring element 29 is formed below the sealing surfaces 27*a*, 27*b*. The pouring element 29 is blow molded together with the other containers 11 and is therefore simultaneously formed with the container in the blow mold by inflating the container material.

Figure 2:
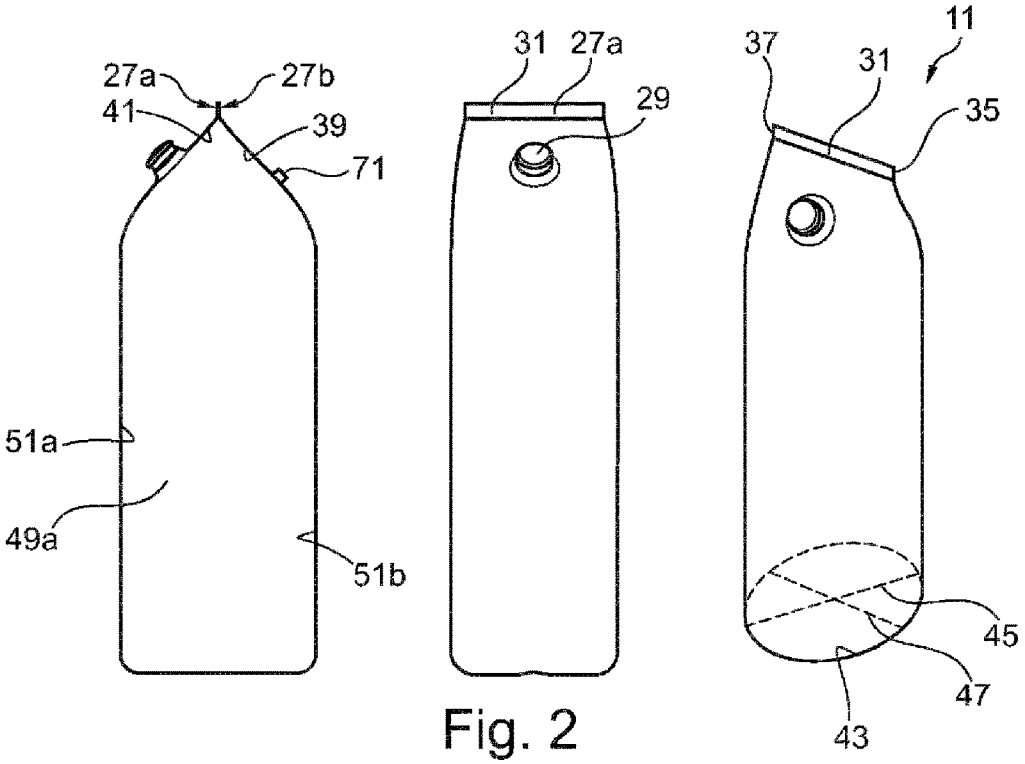
FIG. 2: a 2nd embodiment of an extrusion blow molded container in 3 views.
Figure 3:
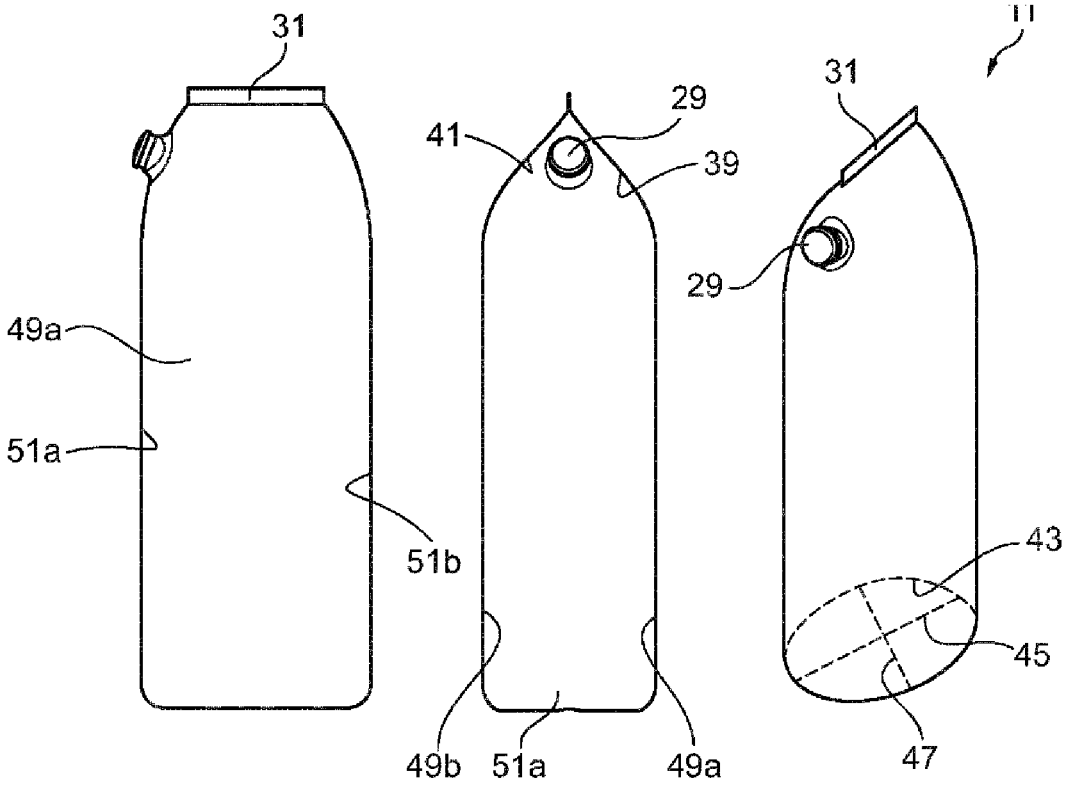
FIG. 3: a 3rd embodiment of an extrusion blow molded container in 3 views.
Figure 4:
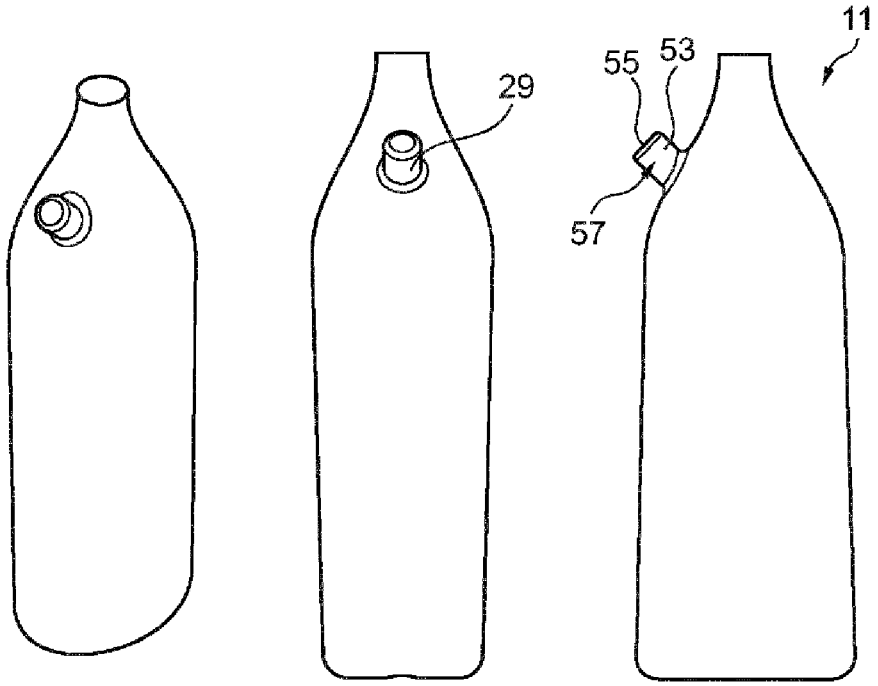
FIG. 4: a 4th embodiment of an extrusion blow molded container in 3 views.
Figure 19:
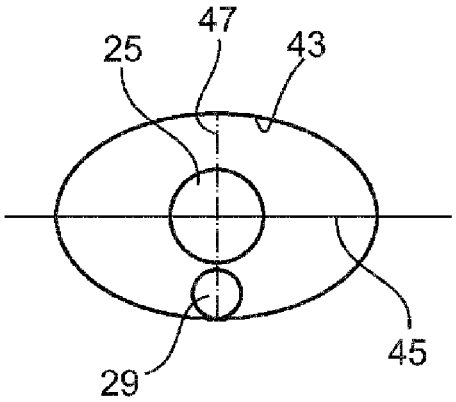
FIG. 19: is a top view of the container with open pour opening.
Figure 20:
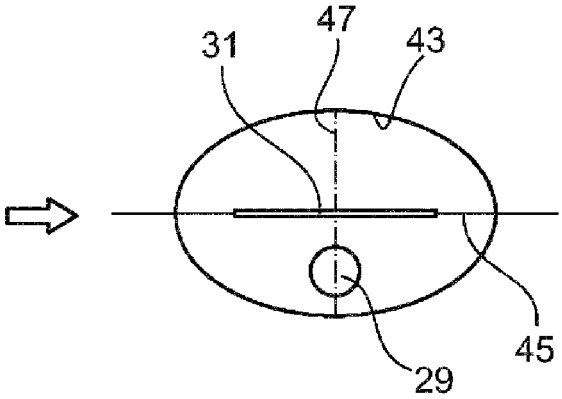
FIG. 20: is a top view of the container with closed pour opening.

After the filling of the container 11, the sealing surfaces 27*a*, 27*b* are connected to one another in a fluid-tight manner by bringing them into contact with one another and thereby closing the filling opening 25. In the closed state, the sealing surfaces 27*a*, 27*b* form a seam 31 that is shown in FIGS. 2 and 3. The seam 31 has a long side 33 and a first and second seam end 35, 37. As a result of this deformation, a first and a second shoulder 39, 41 are formed below the long side 31 on the container 11. The base 19 can have the shape of an ellipse 43, wherein the ellipse 43 has a main axis 45 and a secondary axis 47 (FIGS. 3, 19 and 20). The elliptical shape has the effect that the container 11 has two opposite long sides 49*a*, 49*b* and two opposite short sides 51*a*, 51*b*.

Different positions of the seam 31 and the pouring element 29 are described in the following. In this case, limiting production parameters must be taken into account. A sufficient wall thickness must be present in the region of the tube to be extruded on which the pouring element is formed. The position of the pouring element 29 should not be in the way of the seam 31 that arises when the filling opening 23 is closed. The casting mold seam should not cross the seam 31.

FIG. 2 shows that the seam 31 is oriented parallel to the secondary axis 47. The pouring element 29 is arranged on the short side 51*a*. FIG. 3 shows that the seam 31 is oriented parallel to the main axis 45. The pouring element 29 is arranged on the short side 51*a*. The pouring element can also be arranged on one of the long sides 49*a*, 49*b* (FIG. 20).

FIGS. 19 and 20 show that the pouring element 29 is dimensioned such that it lies within the base 19 or the ellipse 43 in the top view of the container 11. The pouring element 29 therefore lies within the "footprint" of the container 11.

Figure 13:
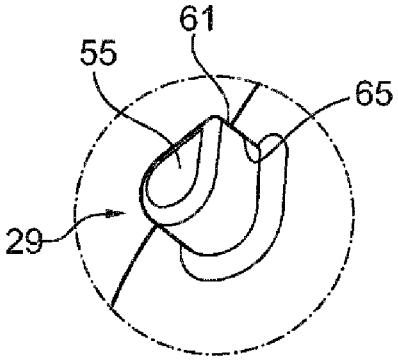
FIG. 13: a 3rd embodiment of the pouring element in a detail view.

The pouring element 29 has a neck 53, a cap 55 and a pour opening 57. The cap 55 closes the pour opening 57 and the neck 53 is formed on the container body 13. A cutting line 59 is formed on the neck 53 and has a reduced wall thickness and therefore represents an attenuation of the neck 53. The cap 55 can be cut off from the neck 53 at this cutting line 59. The cutting line 59 can also be interrupted. The interrupted region 61 can serve as a hinge, which is not cut through (FIG. 13). The cap 55 is held on the hinge 61 so as to be foldable and is disposed of together with the container 11.

Figure 17:
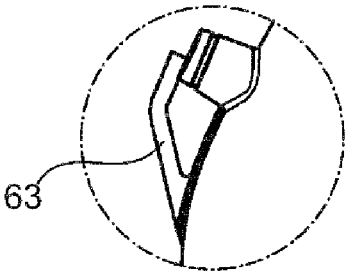
FIG. 17: a 7th embodiment of the pouring element in a detail view.
Figure 18:
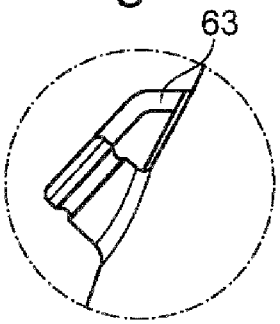
FIG. 18: an 8th embodiment of the pouring element in a detail view.

In order for the cap 55 to be captively held on the container 11, it is connected to the container body 13 by a holding strip 63. The holding strip 63 is formed during the blow molding of the container 11. The holding strip 63 can be formed above or below the pouring element 29 (FIGS. 17 and 18).

Figure 5:
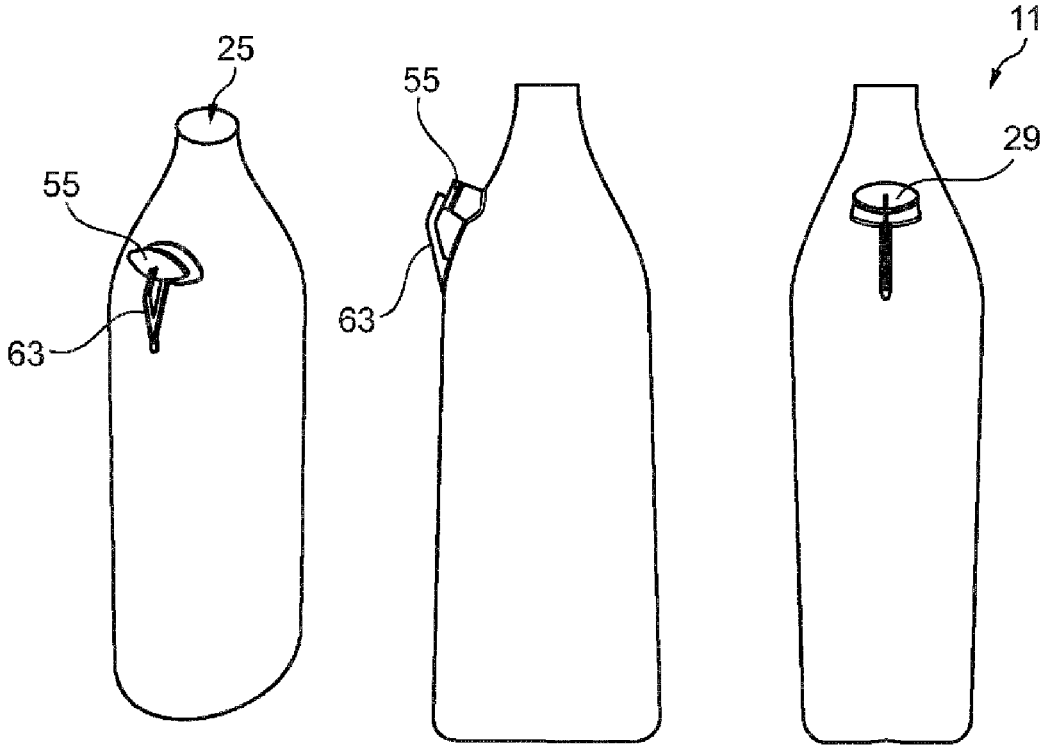
FIG. 5: a 5th embodiment of an extrusion blow molded container in 3 views.
Figure 15:
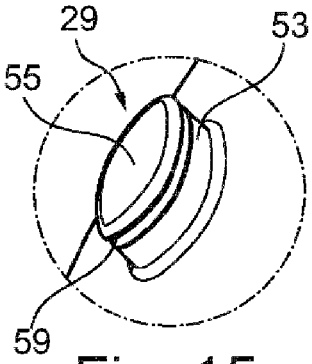
FIG. 15: a 5th embodiment of the pouring element in a detail view.
Figure 16:
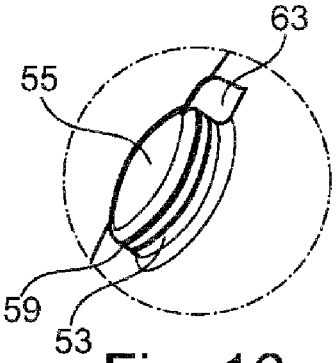
FIG. 16: a 6th embodiment of the pouring element in a detail view.

FIGS. 5, 15 and 16 show that the cross section of the pouring element 29 can be olive-shaped. As a result, scissors only have to be opened slightly in order to cut off the cap 55.

Figure 9:
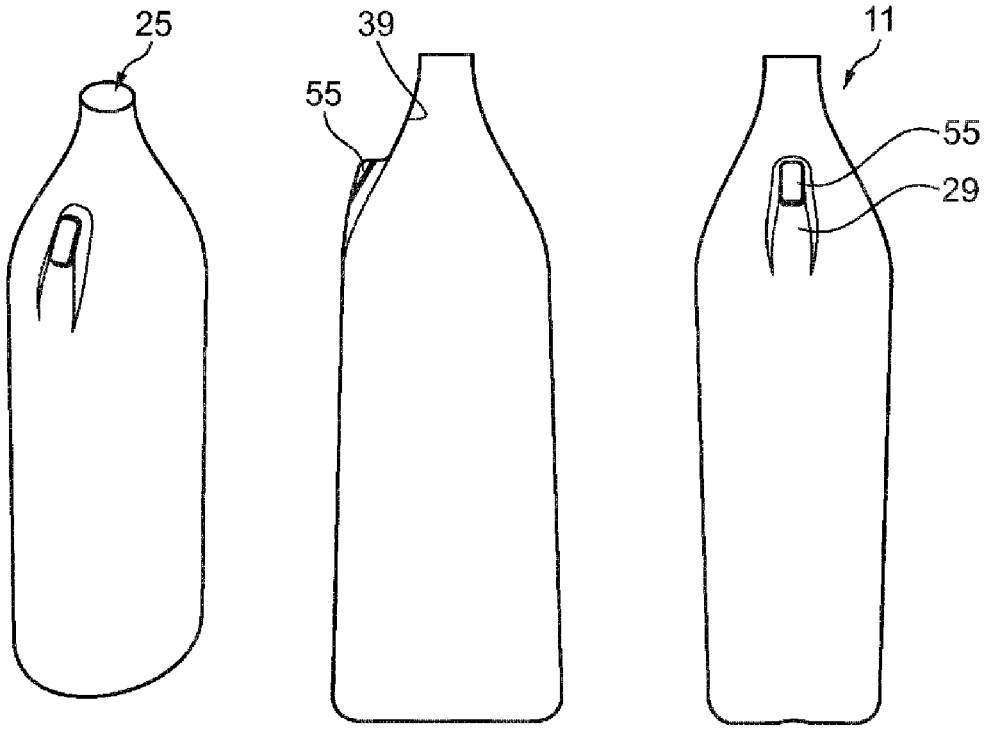
FIG. 9: a 9th embodiment of an extrusion blow molded container in 3 views.
Figure 11:
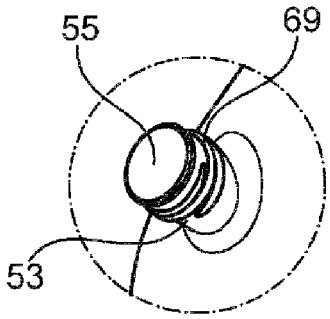
FIG. 11: a 1st embodiment of a pouring element of the container in a detail view.
Figure 12:
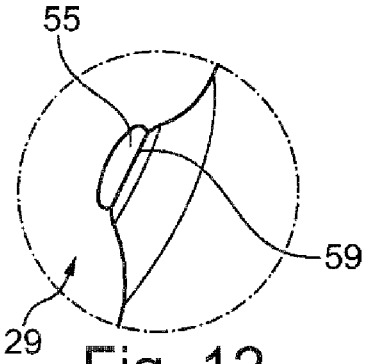
FIG. 12: a 2nd embodiment of the pouring element in a detail view.
Figure 14:
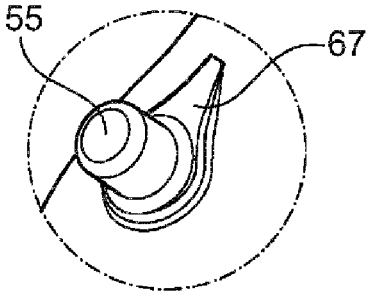
FIG. 14: a 4th embodiment of the pouring element in a detail view.

FIG. 13 shows a pouring element 29 with a teardrop-shaped cross section. The pouring element 29 accordingly has a tip 65 that is oriented in the direction of the filling opening 25. This shaping makes it possible for the pouring element 29 to remain free of deformations and not be distorted when the sealing surfaces 27*a*, 27*b* are connected to one another. The provision of a teardrop-shaped base 67 acts in a similar manner (FIG. 14). The base 67 is formed at the transition from the pouring element 29 to the container body 13. An external thread 69 can also be provided on the neck 53 (FIG. 11), onto which a cap with an internal thread can be screwed. As a result, the container 11 can be closed again after the cap 55 has been cut off. In FIG. 12, the cap 55 is shown in the shape of a lens and the cutting line 59 is realized as a constriction at the neck 53. This embodiment of the pouring element 29 is very low, as a result of which the pouring element 29 lies within the contour of the base 19. FIG. 9 shows a pouring element 29 that fits against the first shoulder 39 and therefore also builds up very low.

Figure 10:
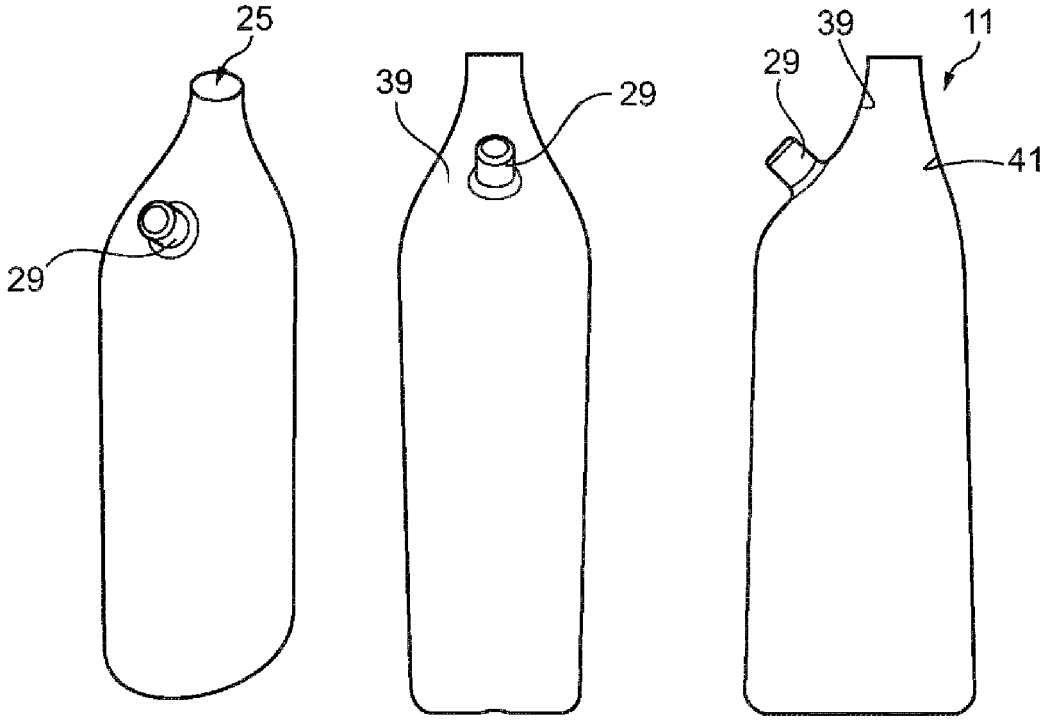
FIG. 10: a 10th embodiment of an extrusion blow molded container in 3 views.

FIG. 10 shows an embodiment of the container 11 with which the first shoulder 39 is longer than the second shoulder 41. The longer first shoulder 41 can be produced by the filling opening 25 having a decentralized or asymmetrical arrangement. The pouring element 29 is arranged on the longer shoulder 39 and is therefore further away from the filling opening 25 than if the filling opening 25 were to be arranged symmetrically with respect to the container. When connecting the sealing surfaces 27*a*, 27*b*, the pouring element 29 remains free of deformations, because it is far away from the sealing surfaces. In addition, the pouring element 29 does not project beyond the base contour.

Figure 6:
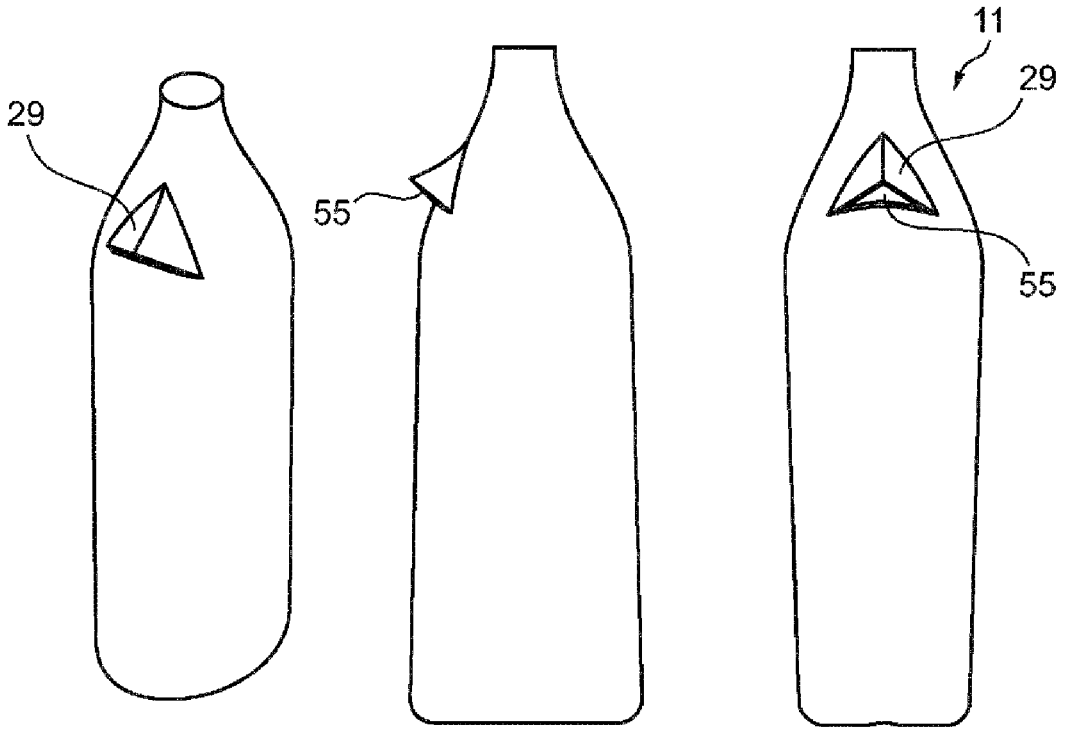
FIG. 6: a 6th embodiment of an extrusion blow molded container in 3 views.
Figure 7:
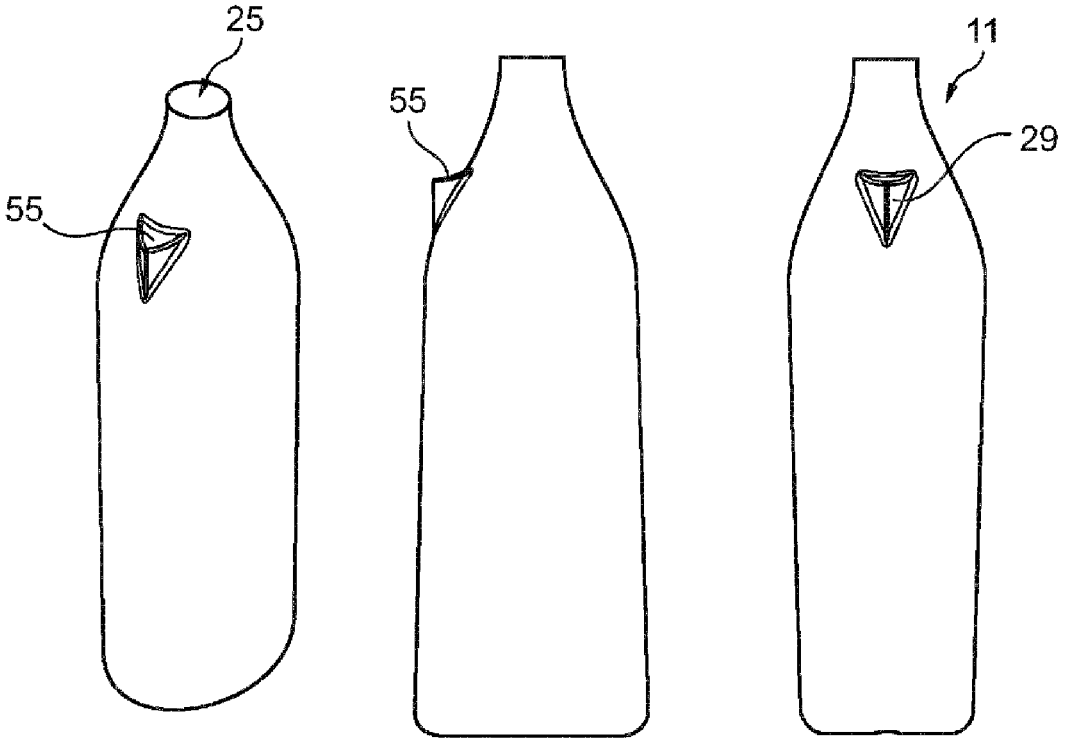
FIG. 7: a 7th embodiment of an extrusion blow molded container in 3 views.

FIGS. 6 and 7 show an embodiment of the container 11 with which the pouring element 29 has the shape of a three-sided pyramid. One of the sides of the pyramid is provided as a cut-off cap 55. In FIG. 6, the cap 55 is oriented downward, which has the advantage that the container as a whole is less deformed during sealing, whereas the cap 55 is oriented upward in FIG. 7. These cap orientations facilitate the pouring of filling material from the container 11.

Figure 8:
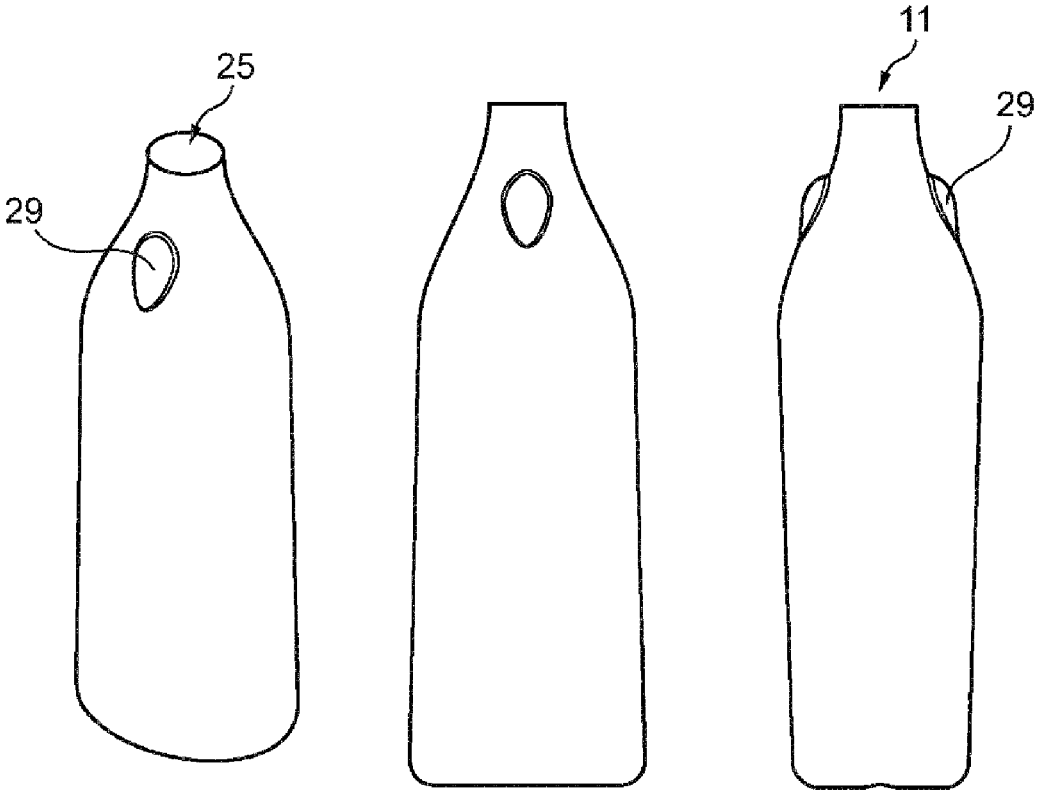
FIG. 8: an 8th embodiment of an extrusion blow molded container in 3 views.

FIG. 8 shows an embodiment of the container 11 with which the pouring element 29 is formed close to the filling opening 25. As a result, the pouring element 29 can directly adjoin the seam 31 after the filling opening 25 is closed. Dead spaces between the pouring element 29 and the seam 31 are prevented and the container can be completely emptied. In this embodiment, in which the pouring element 29 adjoins or even protrudes into the seam 31, the pouring element 29 is a lens-shaped projection. A lens-shaped projection 29 can also be formed on each of the first and second shoulders 39, 41. The lens-shaped projections lie opposite one another.

Figure 21:
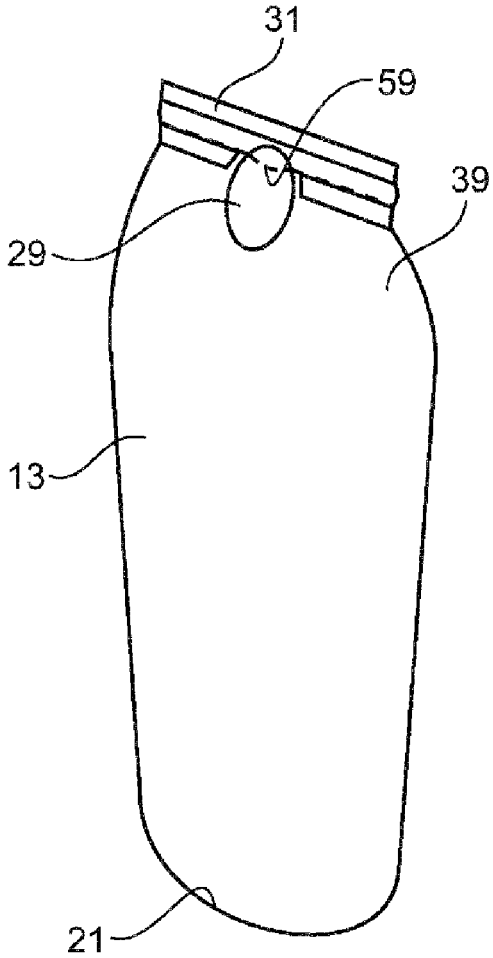
FIG. 21 a perspective view of an extrusion blow molded container with a seam in a first embodiment, and FIG. 22 a perspective view of an extrusion blow molded container with a seam in a second embodiment.
Figure 22:
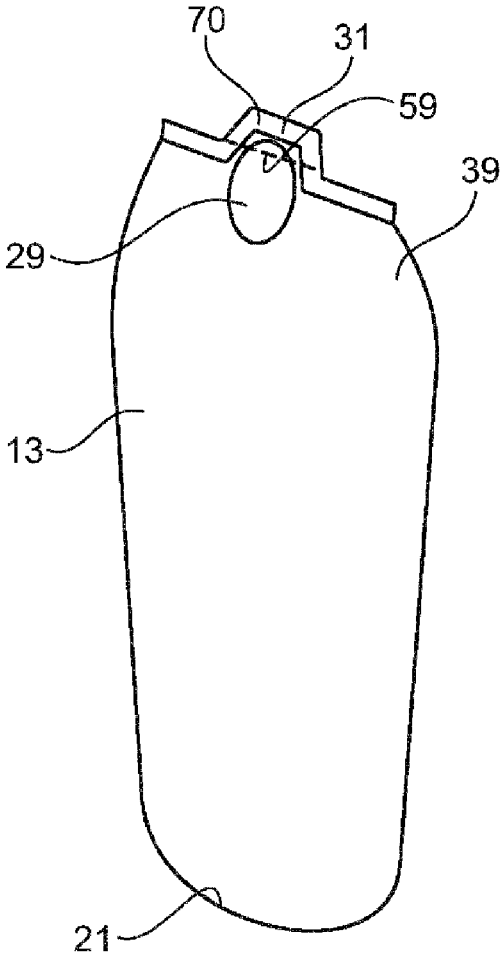

FIGS. 21 and 22 show the embodiment of the container 11 from FIG. 8 with a closed or welded filling opening 25. The lens-shaped pouring element 29 makes it possible for it to directly adjoin the seam 31 or project into the seam 31. The pouring element 29 can easily be opened by cutting the seam 31 along the cutting line 59. If two lens-shaped projections 29, as shown in FIG. 8, are formed on the first or the second shoulder 39, 41, both pouring elements 29 are opened with a cut. This results in an enlarged pour opening.

FIG. 22 shows that the seam 31 partially surrounds or frames the lens-shaped projection 29. As a result, the seam 31 forms a tab 70. To open the pouring element 29, only the tab 70 has to be cut along the cutting line 59.

In order to form a homogeneous filling material flow during pouring, a ventilation opening 71 can be provided on the container body 13 (FIG. 2). This can be realized by a nipple that can be cut.

The extrusion blown container 11 is integrally formed, and the pouring element 29 together with the container body 13 is blown in a mold. The pouring element 29 is therefore an integral component of the container 11 and does not have to be subsequently inserted therein and connected thereto.

The invention claimed is:

1. A container produced from a plastic material, especially in extrusion blow molds, comprising:

a container body having a first end and a second end substantially opposite the first end;

a first sealing surface and a second sealing surface formed on an inner wall of the first end, wherein the first and second sealing surfaces surround a filling opening and are configured to be connected to one another in a fluid-tight manner, wherein the first and second sealing surfaces form a seam with a long side and a first and second seam end when the sealing surfaces are connected in the fluid-tight manner, wherein a first and a second shoulder are formed on the container adjacent to the long side of the seam, and wherein the first shoulder is longer than the second shoulder and the pouring element is formed on the first shoulder;

a container base forming a standing surface at the second end; and a pouring element formed on the container body at the first end below the first and second sealing surfaces.

2. The container according to claim 1, wherein the pouring element is blow molded together with the container.

3. The container according to claim 1, wherein the pouring element is formed below the long side of the seam.

4. The container according to claim 1, wherein the pouring element is formed below the first or second seam end.

5. The container according to claim 1, wherein the container base has a shape of an ellipse with a main axis and a secondary axis, whereby the container has two opposing long sides and two opposing short sides.

6. The container according to claim 5, wherein the seam is oriented parallel to the main axis.

7. The container according to claim 5, wherein the seam is oriented parallel to the secondary axis.

8. The container according to claim 5, wherein the pouring element is formed on one of the short sides.

9. The container according to claim 5, wherein the pouring element is formed on one of the long sides.

10. The container according to claim 1, wherein the pouring element has a height, so that in a top view of the container the pouring element is within contours of the container base.

11. The container according to claim 1, wherein the pouring element has a neck, a cap and a pour opening, wherein the cap closes the pour opening.

12. The container according to claim 11, further comprising a cutting line formed at the neck.

13. The container according to claim 11, wherein the cap is connected to the container body by a holding strip.

14. The container according to claim 1, wherein the pouring element is olive-shaped in cross-section.

15. The container according to claim 1, wherein the pouring element is teardrop-shaped in cross-section.

16. The container according to claim 1, wherein a teardrop-shaped base is formed at a transition from the pouring element to the container body.

17. The container according to claim 1, wherein the pouring element has a pyramid shape, wherein one side of the pyramid shape is a cut-off cap.

18. The container according to claim 17, wherein the cut-off cap has a truncated cone shape.

19. The container according to claim 1, wherein the pouring element adjoins the long side of the seam or projects into the seam.

20. The container according to claim 2, wherein the pouring element has a lens-shaped projection.

21. The container according to claim 2, further comprising a pair of lens-shaped projections, each formed on one of the first and second shoulders, which lens-shaped projections lie opposite one another on the shoulders.

22. The container according to claim 1, further comprising a vent opening on the container body.

23. The container according to claim 1, further comprising a closure cap configured to close the pour opening in a fluid-tight manner.

24. The container according to claim 23, further comprising an interrupted cutting line at the neck and wherein the cutting line in an interrupted region thereof acts as a hinge for the closure cap.

25. The container according to claim 1, wherein the container body, first and second sealing surface, container base and pouring element are integrally formed.

26. A container produced from a plastic material in extrusion blow molds, comprising:

a container body having a first end and a second end substantially opposite the first end;

a first sealing surface and a second sealing surface formed on an inner wall of the first end, wherein the first and second sealing surfaces surround a filling opening and are configured to be connected to one another in a fluid-tight manner, wherein the first and second sealing surfaces form a seam with a long side and a first and second seam end when the sealing surfaces are connected in the fluid-tight manner, wherein a first and a second shoulder are formed on the container adjacent to the long side of the seam, and wherein the container base has a shape of an ellipse with a main axis and a secondary axis, whereby the container has two opposing long sides and two opposing short sides;

a container base forming a standing surface at the second end; and a pouring element formed on the container body at the first end below the first and second sealing surfaces.

27. A container produced from a plastic material in extrusion blow molds, comprising:

a container body having a first end and a second end substantially opposite the first end;

a first sealing surface and a second sealing surface formed on an inner wall of the first end, wherein the first and second sealing surfaces surround a filling opening and are configured to be connected to one another in a fluid-tight manner;

a container base forming a standing surface at the second end;

a pouring element formed on the container body at the first end below the first and second sealing surfaces, the pouring element blow molded together with the container;

first and a second shoulders formed on the container; and a pair of lens-shaped projections, each formed on one of the first and second shoulders, which lens-shaped projections lie opposite one another on the first and second shoulders.

* * * * *